United States Patent [19]

Jarreau

[11] 4,253,820

[45] Mar. 3, 1981

[54] FIREPLACE LIGHTER

[76] Inventor: Donald J. Jarreau, 7350 Memo Pl., Baton Rouge, La. 70816

[21] Appl. No.: 37,765

[22] Filed: May 10, 1979

[51] Int. Cl.[3] ..... F23D 13/04; F23Q 13/04

[52] U.S. Cl. ..... 431/344; 431/345; 126/25 B

[58] Field of Search ..... 126/25 B; 431/254, 255, 431/276, 277, 344, 345

[56] References Cited

U.S. PATENT DOCUMENTS

| | | | |
|---|---|---|---|
| 2,581,304 | 1/1952 | Sims | 431/345 |
| 2,728,212 | 12/1955 | Costello | 431/274 |
| 3,890,087 | 6/1975 | Jackson | 431/277 |
| 4,013,398 | 3/1977 | Hendrix | 431/344 |

*Primary Examiner*—Carroll B. Dority, Jr.
*Assistant Examiner*—Lee E. Barrett
*Attorney, Agent, or Firm*—David L. Ray; Edgar E. Spielman, Jr.

[57] ABSTRACT

The lighter of the present invention includes a handle for grasping by the user connected to a chamber for holding a disposable lighter. The chamber has a trigger mechanism connected thereto for depressing the fuel releasing element of the lighter. The chamber also has a hollow metal rod extending therefrom and aligned with the fuel supply element of the lighter in such a manner as to convey the fuel from the lighter to the end of the rod.

10 Claims, 7 Drawing Figures

FIREPLACE LIGHTER

BACKGROUND OF THE INVENTION

The present invention relates generally to fire-igniting devices especially adapted for use in lighting fireplaces and furnaces. In using fuel or gas-burning appliances such as furnaces, heaters, ovens, and the like, it is necessary on occasion to ignite flames therein. Even if a furnace uses a pilot light, the pilot light itself must be relit after the furnace has been shut down or the fuel gas supply interrupted.

If the gas-burner is often in a location of difficulty to reach by hand, lighting it may be an awkward and unsafe task. Holding a match near the burner may be difficult and often results in the match flame being blown out by the air that rushes out of the burner when displaced by the gas. If gas is allowed to accumulate outside the burner before the flame is applied, a small explosion occurs which may result in singeing or seriously burning the person igniting the gas.

Various forms of ignition devices having elongated handles for igniting inaccessible burner elements or the like are known. Examples of some of the previously patented devices of the various types of lighting mechanisms of the prior art are U.S. Pat. Nos. 4,013,398; 3,890,087; 3,410,261; 3,033,275; 2,781,653; 2,728,212; and, 2,581,304.

SUMMARY OF THE INVENTION

The lighter of the present invention includes a handle for grasping by the user connected to a chamber for holding a disposable lighter. The chamber has a trigger mechanism connected thereto for depressing the fuel releasing element of the lighter. The chamber also has a hollow metal rod extending therefrom and aligned with the fuel supply element of the lighter in such a manner as to convey the fuel from the lighter to the end of the rod.

DESCRIPTION OF THE PREFERRED EMBODIMENTS

Figure 1:
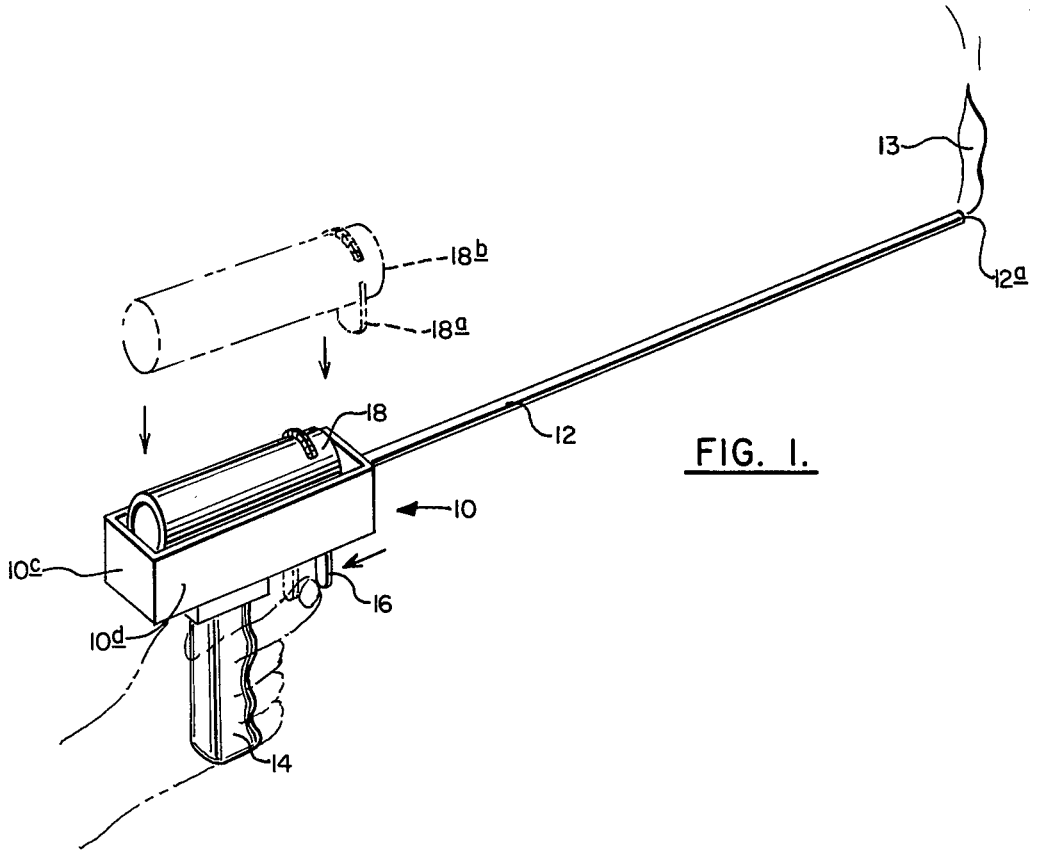
FIG. 1 is a perspective view of the invention showing a "ghosted-in" lighter and a "ghosted-in" trigger.

Referring to the drawings, a perspective view of the invention is shown in FIG. 1. As can be seen in FIG. 1, and in FIGS. 2–7, the lighter of the present invention includes a hollow chamber, generally indicated by the numeral 10, which is rectangular in shape and contains four sides, **10*a* through 10*d*. The front wall of the chamber is labeled 10*a* and the rear wall is labeled 10*c*, and the two side walls are 10*b* and 10*d***.

Figure 2:
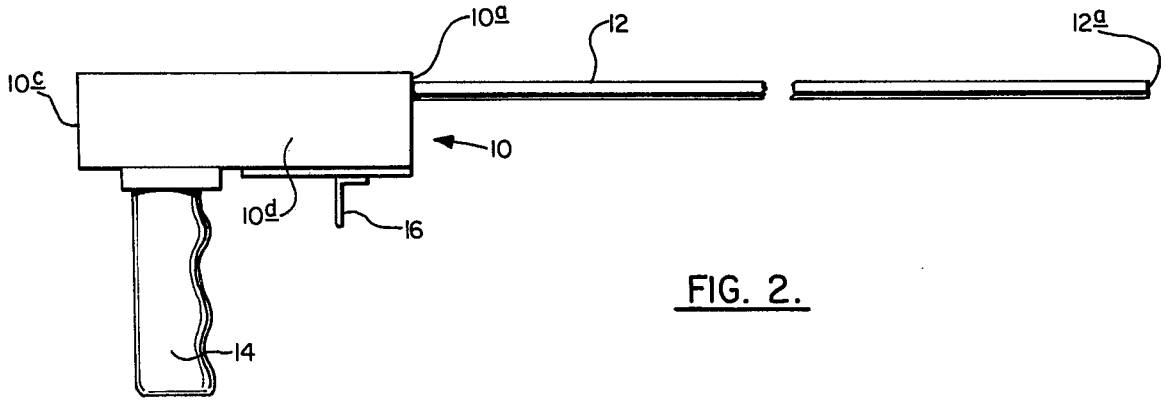
FIG. 2 is a partly cut-away, side elevational view of the lighter of the present invention.
Figure 3:
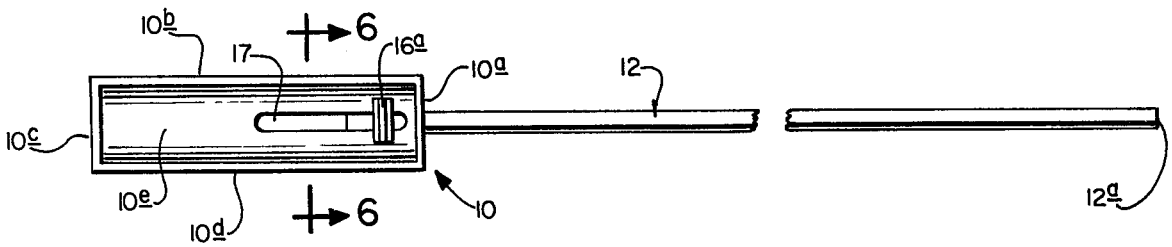
FIG. 3 is a partly cut-away, top elevational view of the lighter of the prevent invention with the disposable lighter removed.
Figure 4:
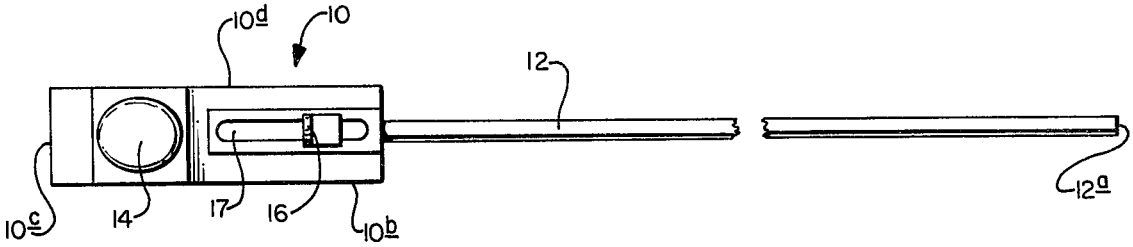
FIG. 4 is a bottom view of the lighter of the present invention.
Figure 5:
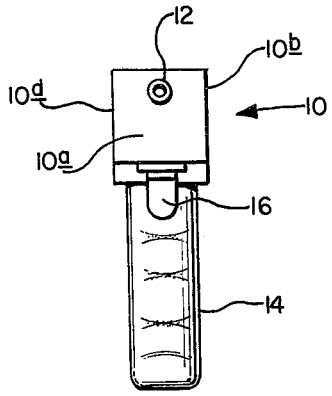
FIG. 5 is a front view of the lighter of the present invention.
Figure 6:
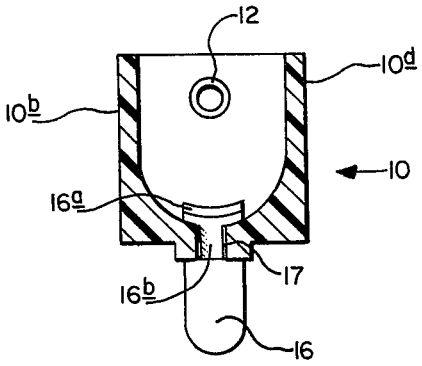
FIG. 6 is a cross-sectional view taken along lines 6—6 of FIG. 3; and, FIG. 7 is a partly cross-sectional, partly cut-away view of the trigger mechanism of the present invention.

Extending from the front wall **10*a* of chamber 10 is a hollow tube, preferably metal, indicated by the numeral 12. Located on the bottom 10*e* of chamber 10 is a handle 14 for grasping by the user. Handle 14 may have a pistol grip as shown in FIGS. 1 and 2**, or it may be of any other desired configuration.

Located in the bottom **10*e* of chamber 10 is slot 17 containing a portion 16*b* (see FIG. 6) of trigger 16. Trigger 16 is held in slot 17 by tab 16*a* (see FIGS. 6 and 7) and is slidable in the slot 17**.

As shown in FIG. 1, chamber 10 is adapted to receive a disposable lighter referred to generally as "butane lighters" which have gained wide acceptance as conventional lighters for lighting cigarettes, cigars, and the like. Examples of such lighters are shown in U.S. Pat. Nos. 3,890,087 and 4,013,398. The disposable lighters have a spring loaded valve **18*a* which, when depressed, releases butane or other flammable gas from a hole in the front end 18*b*** of the lighter.

Figure 7:
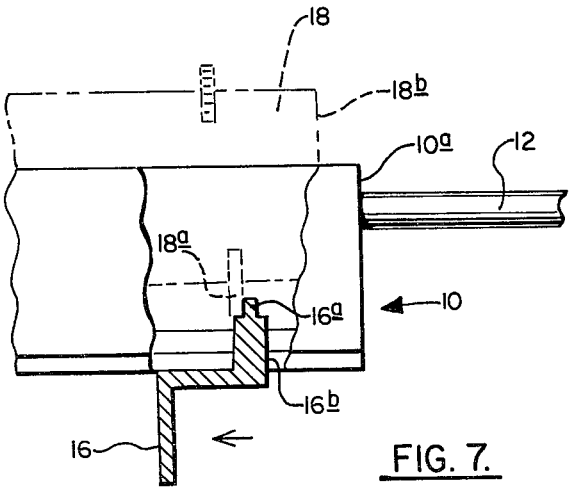

As can be seen in FIG. 7, tab **16*a* connected to trigger 16 is adapted to contact valve 18*a* on disposable butane lighter 18. Thus, when trigger 16 is pulled backward as shown by the arrow in FIG. 1 and FIG. 7, tab 16*a* strikes valve 18*a* of lighter 18 and releases butane therefrom. Tube 12 is aligned to receive butane released from lighter 18 and to convey it to the end 12*a* of tube 12**.

The butane then may be ignited at the end of tube 12 to form flame 13 shown in FIG. 1. Ignition of the butane is by match, spark, or some other flame source. The embodiment of lighter 18 shown in the drawings does not contain means therein for ignition of the butane, although such means could be added if desired. Tube 12 may be slidable in wall **10*a* of chamber 10** to assure a tight fit over the fuel supply hole of the disposable lighter.

Thus, to operate the lighter of the present invention, the trigger 16 is depressed as shown by the arrow and "ghosted" portion of FIG. 1 and a match is placed at the end **12*a* of tube 12. As a result, flame 13 occurs and then may be placed inside a fireplace or furnace to light a pilot light or the fireplace. The flame is extinguished by releasing the pressure on the trigger 16**.

Although the preferred embodiments of the present invention have been disclosed and described in detail above, it should be understood that the invention is in no sense limited thereby and its scope is to be determined by that of the following claims:

What is claimed is:

1. A fireplace lighter comprising:

a. chamber means adapted for receiving disposable lighter means;

b. handle means connected to said chamber means for grasping by the user;

c. an elongated hollow tube connected to said chamber means for receiving the conveying flammable gas from said disposable lighter means; and, d. slidable trigger means connected to said chamber means for releasing flammable gas from said disposable lighter.

2. The apparatus of claim 1 wherein said chamber means has two side walls and two end walls, the side walls and end walls being parallel, respectively, each of said walls being rectangular in shape.

3. The apparatus of claim 1 wherein said chamber is open at the top and has a rectangular bottom wall connected at its edges to all said side walls and said end walls.

4. The apparatus of claim 3 wherein said bottom wall has a slot therein for receipt of said trigger means.

5. The apparatus of claim 4 wherein said trigger means has a portion thereof which is slidable in said slot means.

6. The apparatus of claim 5 wherein said trigger means has tab means connected thereto for slidably engaging valve means located on said disposable lighter means to release butane from said disposable lighter means.

7. The apparatus of claim 1 including a disposable lighter means having a hole therein for releasing fuel which is alignable with said hollow tube.

8. The apparatus of claim 7 wherein said tube is slidable in said chamber means.

9. The apparatus of claim 1 wherein said chamber means has two side walls and two end walls, the side walls and end walls being parallel, respectively, each of said walls being rectangular in shape; wherein said chamber is open at the top and has a rectangular bottom wall connected at its edges to all said side walls and said end walls; and, wherein said bottom wall has a slot therein for receipt of said trigger means.

10. The apparatus of claim 1 wherein said trigger means has a portion thereof which is slidable in said slot means and wherein said trigger means has tab means connected thereto for slidably engaging valve means located on said disposable lighter means to release butane from said disposable lighter means.

* * * * *